US006292979B1

(12) United States Patent
Kuo

(10) Patent No.: US 6,292,979 B1
(45) Date of Patent: Sep. 25, 2001

(54) POSITIONING STRUCTURE OF RETRACTABLE DRAW BAR FOR A SUITCASE

(75) Inventor: Chung-Hsien Kuo, Taipei Hsien (TW)

(73) Assignee: Chaw Khong Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 09/598,023

(22) Filed: Jun. 21, 2000

(51) Int. Cl.[7] ..... A45C 3/00; B25G 1/04

(52) U.S. Cl. ..... 16/113.1; 16/429; 16/DIG. 41; 403/326

(58) Field of Search ..... 16/113.1, 405, 16/429, DIG. 41; 190/115, 18 A, 18 R; 280/47.315, 47.371, 655.1, 655; 403/326, 328, 319, 316

(56) References Cited

U.S. PATENT DOCUMENTS

| | | | | |
|---|---|---|---|---|
| 5,653,000 | * | 8/1997 | ILee | 16/113.1 |
| 5,890,257 | * | 4/1999 | Edele et al. | 403/326 |
| 6,202,254 | * | 3/2001 | Ezer | 16/113.1 |

* cited by examiner

*Primary Examiner*—Chuck Y. Mah
(74) *Attorney, Agent, or Firm*—Rosenberg, Klein & Lee

(57) ABSTRACT

The present invention proposes a positioning structure of a retractable draw bar, wherein an extended sheet is formed at the upper edge of each of the retaining holes of the first joint tube to increase the area of the upper edge of the retaining hole. When the retaining buttons of the positioning seat is fastened in the retaining holes and bear an upward force, the contact area of the upper edges thereof will be larger. Therefore, the retaining buttons can bear larger load so that they will not break or be damaged because of large shearing force. The lifetime can thus be greatly increased.

5 Claims, 6 Drawing Sheets

POSITIONING STRUCTURE OF RETRACTABLE DRAW BAR FOR A SUITCASE

FIELD OF THE INVENTION

The present invention relates to a positioning structure of a retractable draw bar for a suitcase and, more particularly, to a positioning structure of a retractable draw bar letting the joining of a first joint tube and a positioning seat be steadier. The present invention also has the advantage that the retaining button of the positioning seat will not break or be damaged so that the lifetime can be greatly increased.

BACKGROUND OF THE INVENTION

For a suitcase 11*a* shown in FIG. 1 with rollers 10*a* installed at the bottom thereof, there is a retractable draw bar 12*a* allocated to facilitate the protraction/retraction of a pull handle 13*a* so that the pull handle 13*a* can be pulled out to a full extent to be gripped conveniently when used and be retracted to a compact position when not used.

As shown in FIGS. 2 and 3, the retractable draw bar 12*a* comprises basically a first joint tube 14*a*, a second joint tube 15*a*, and a positioning seat 16*a*. The caliber of the first joint tube 14*a* is slightly larger than that of the second joint tube 15*a* so that the second joint tube 15*a* can be retractably inserted therein. Two circular retaining holes 18*a* are respectively disposed on two opposite tube walls near an upper opening 17*a* of the first joint tube 14*a*. The positioning seat 16*a* is sheathed in the upper opening 17*a* of the first joint tube 14*a*. Two circular retaining buttons 19*a* are respectively formed on two opposite sides of the positioning seat 16*a*. The positioning seat 16*a* can be joined at the upper opening 17*a* through the fastening of the retaining buttons 19*a* in the retaining holes 18*a*. A fixing element 20*a* can be fixed in the lower opening of the second joint tube 15*a*. When the second joint tube 15*a* is pulled upwards in the first joint tube 14*a* until the fixing element 20*a* sticks to the positioning seat 16*a*, the second joint tube 15*a* can be positioned there so that it will not slide out of the first joint tube 14*a*.

However, in the above positioning structure of a retractable draw bar in prior art, the positioning seat 16*a* and the first joint tube 14*a* are joined through the fastening of the retaining buttons 19*a* in the retaining holes 18*a*. When the second joint tube 15*a* is pulled upwards, the positioning seat 16*a* will bear an upward force. The retaining buttons 19*a* and the retaining holes 18*a* will bear this force via the upper edges thereof. Because the contact area of the upper edges of the retaining buttons 19*a* and the retaining holes 18*a* is very small, the retaining buttons 19*a* will easily break or be damaged because of large pressure. Therefore, the positioning seat 16*a* can not be steadily joined at the upper opening 17*a* of the first joint tube 14*a* so that the positioning seat 16*a* can not achieve its original positioning function.

SUMMARY AND OBJECTS OF THE PRESENT INVENTION

The primary object of the present invention is to provide a positioning structure of a retractable draw bar, wherein the contact area of the retaining buttons and the retaining holes can be increased so that the retaining buttons can bear larger load when the positioning seat bears an upward force. Thereby, the retaining buttons will not break or be damaged because of large shearing force. The positioning seat thus can be steadily joined at the upper opening of the first joint tube to achieve its positioning function.

To achieve the above object, the present invention provides a positioning structure of a retractable draw bar, which comprises at least a first joint tube and a positioning seat. Two retaining holes are respectively disposed at two opposite tube walls near an upper opening of the first joint tube. An extended plate raised on the inner wall of the first joint tube is formed at the upper edge of each retaining hole. Two retaining buttons are respectively formed on two opposite sides of the positioning seat. The positioning seat is sheathed in the upper opening of the first joint tube. The positioning seat is joined at the upper opening of the first joint tube through the fastening of the retaining buttons in the retaining holes with the extended sheets situated above the retaining buttons of the positioning seat.

The various objects and advantages of the present invention will be more readily understood from the following detailed description when read in conjunction with the appended drawings, in which:

DETAILED DESCRIPTION OF PREFERRED EMBODIMENT

Figure 1:
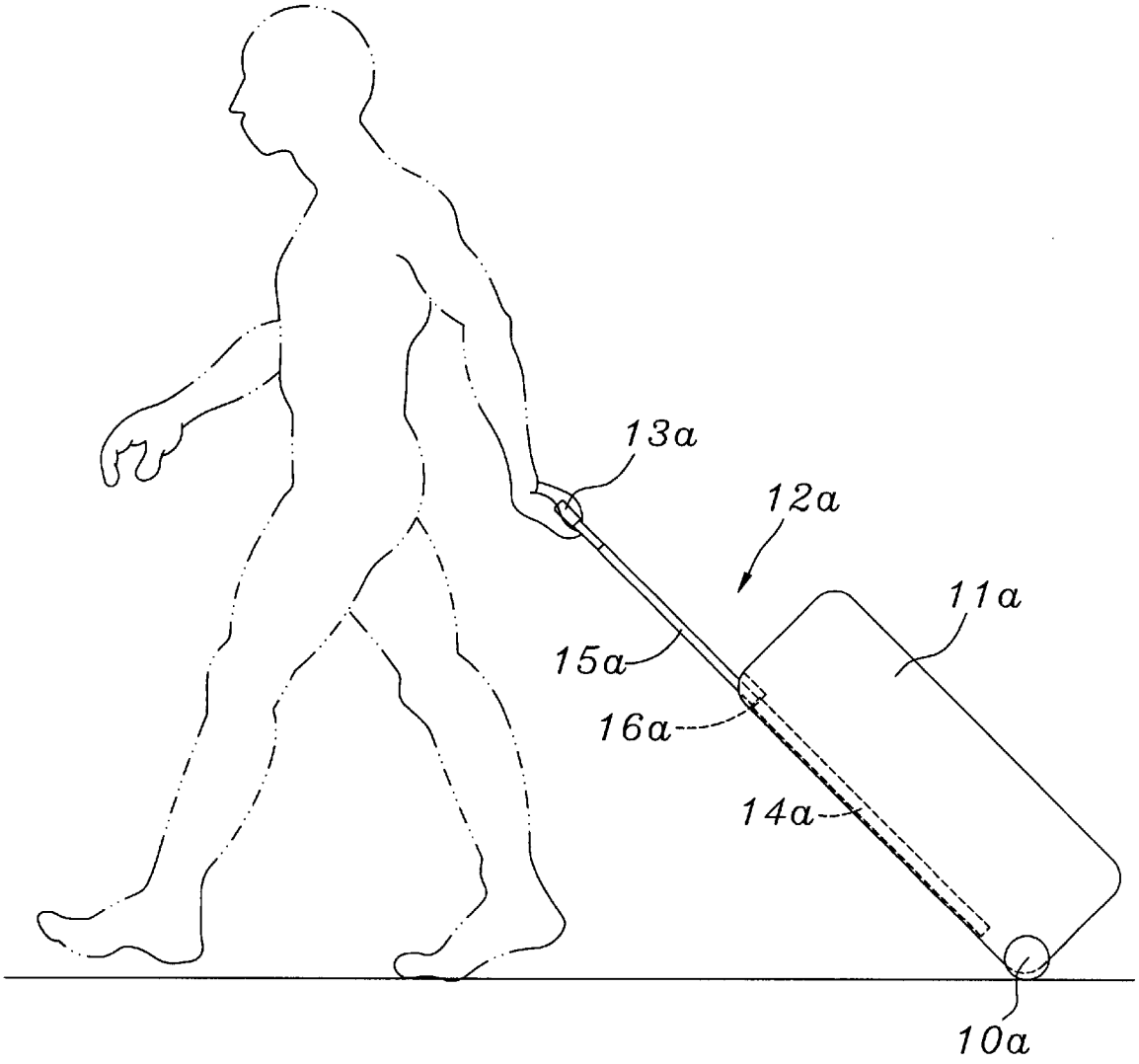
FIG. 1 PRIOR ART
FIG. 1 is a plan view of a suitcase in use in prior art.
Figure 2:
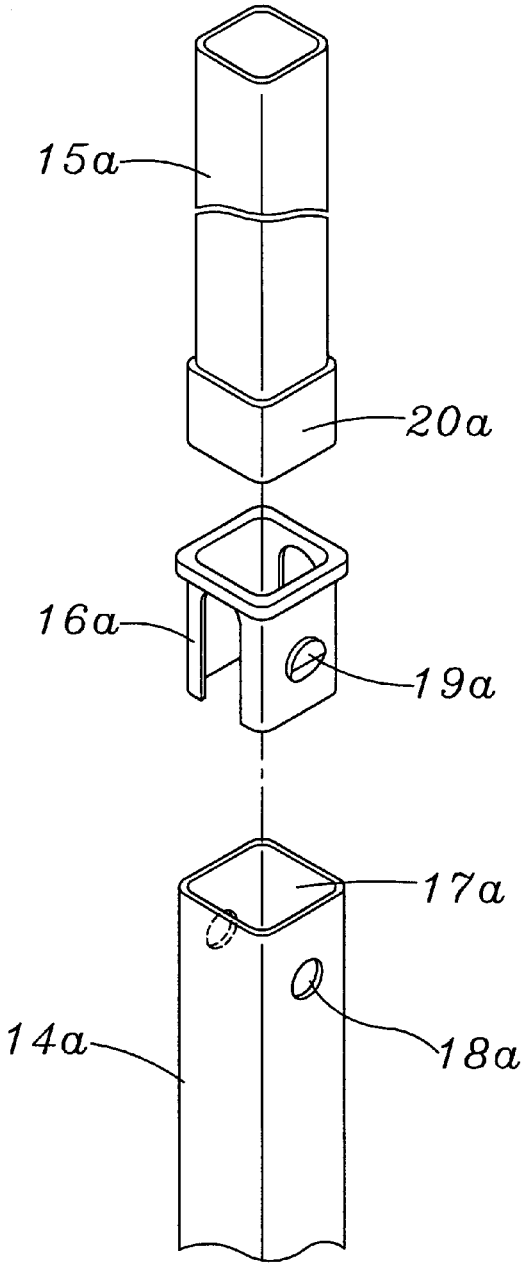
FIG. 2 PRIOR ART
FIG. 2 is an exploded perspective view of a positioning structure of a retractable draw bar in prior art.
Figure 3:
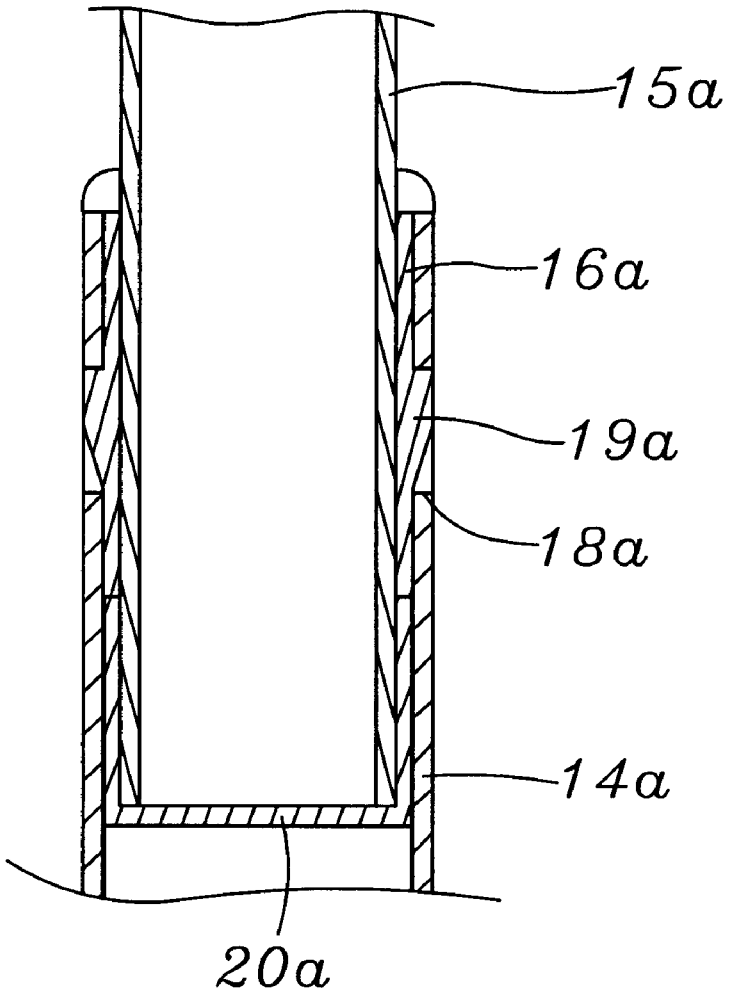
FIG. 3 PRIOR ART
FIG. 3 is a cross-sectional view of a positioning structure of a retractable draw bar in prior art.
Figure 4:
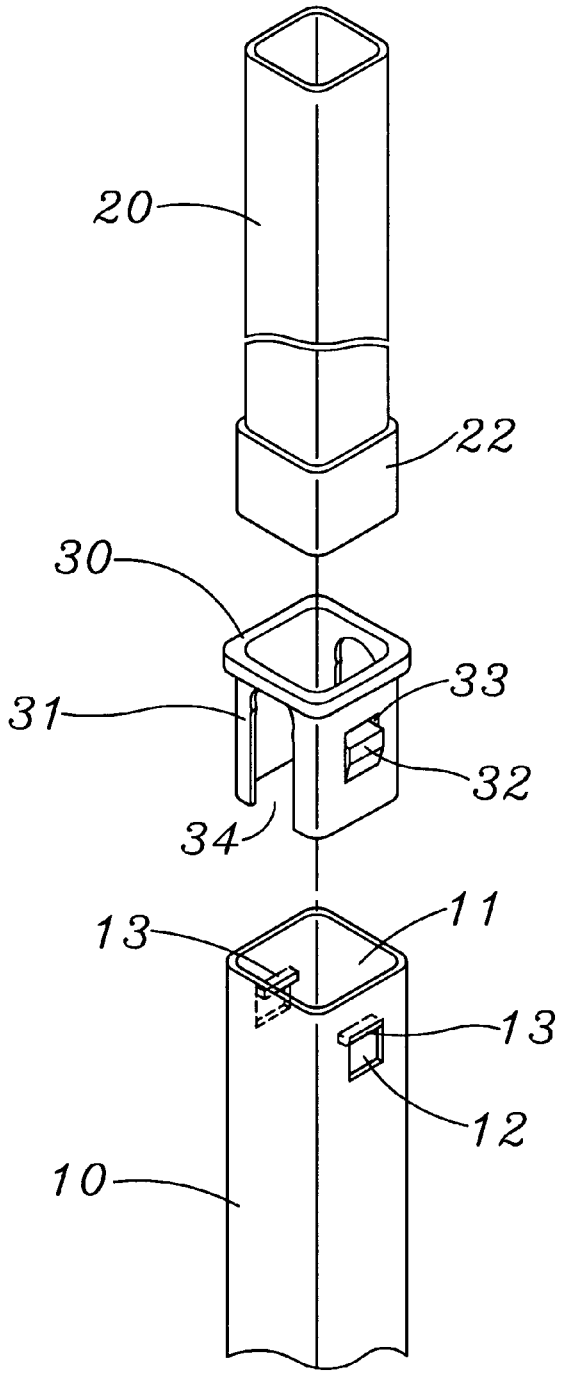
FIG. 4 is an exploded perspective view of the present invention.
Figure 5:
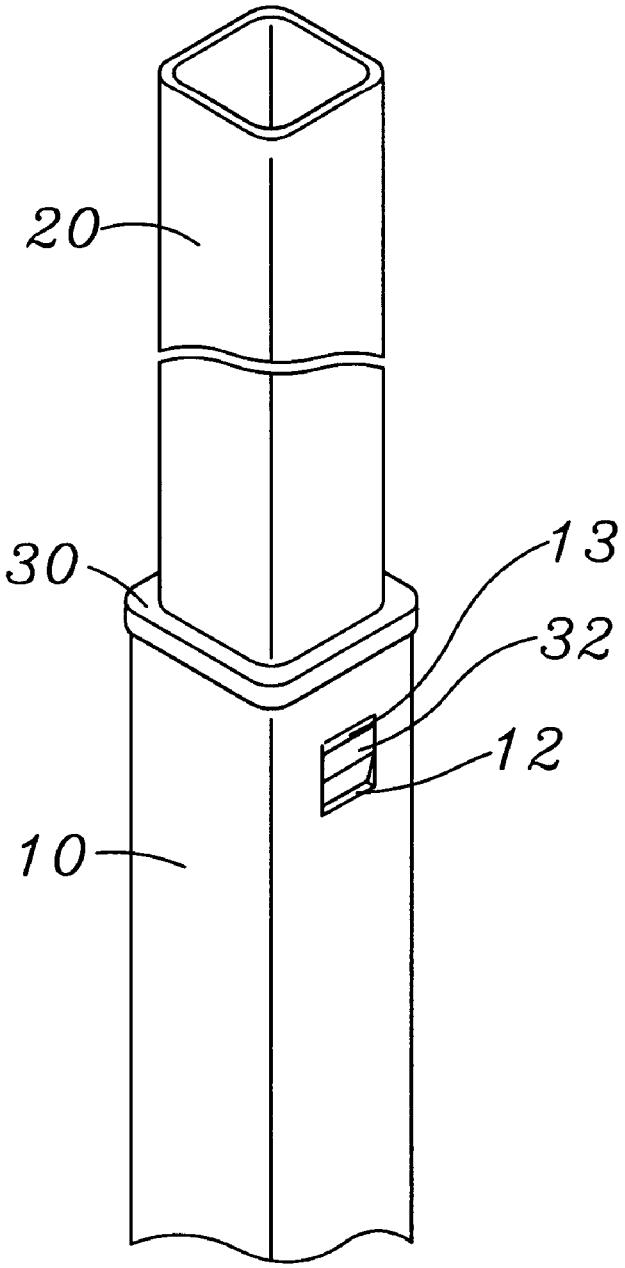
FIG. 5 is a perspective view of the present invention.

FIG. 4 shows a positioning structure of a draw bar applied to a suitcase or any other device having a retractable draw bar to facilitate the protraction/retraction of a pull handle so that the pull handle can be pulled out to a full extent to be gripped conveniently when used and be retracted to a compact position when not used. The positioning structure of a retractable draw bar of the present invention comprises a first joint tube 10, a second joint tube 20, and a positioning seat 30 (please also refer to FIGS. 5 and 6). The first joint tube 10 is a rectangular tube with a caliber slighter larger than that of the second joint tube 20. Two rectangular retaining holes 12 are respectively disposed on two opposite tube walls near an upper opening 11 of the first joint tube 10. An extended plate 13 raised on the inner wall of the first joint tube 10 is formed at the upper edge of each retaining hole 12.

The second joint tube 20 is also a rectangular tube and is retractably inserted in the first joint tube 10. A fixing element 22 is fixed at a lower opening 21 of the second joint tube 20.

The positioning seat 30 is a rectangular hollow seat whose bottom forms a plugging part 31. Two rectangular retaining buttons 32 are respectively formed on two opposite sides of the plugging part 31. A through hole 33 penetrating through one side wall of the plugging part 31 is disposed above each of the retaining buttons 32. Two cut trenches 34 whose bottom ends are open are respectively disposed on the other two opposite sides of the plugging part 31. The plugging part 31 of the positioning seat 30 is sheathed in the upper opening 11 of the first joint tube 10. The positioning seat 30 is joined at the upper opening 11 through the fastening of the retaining buttons 32 in the retaining holes 12 with the extended sheets 13 of the first joint tube 10 inserted in the through holes 33 of the positioning seat 30 and situated above the retaining buttons 32 of the positioning seat 30. Thereby, the positioning seat 30 can be joined at the upper opening 11 of the first joint tube 10.

Figure 6:
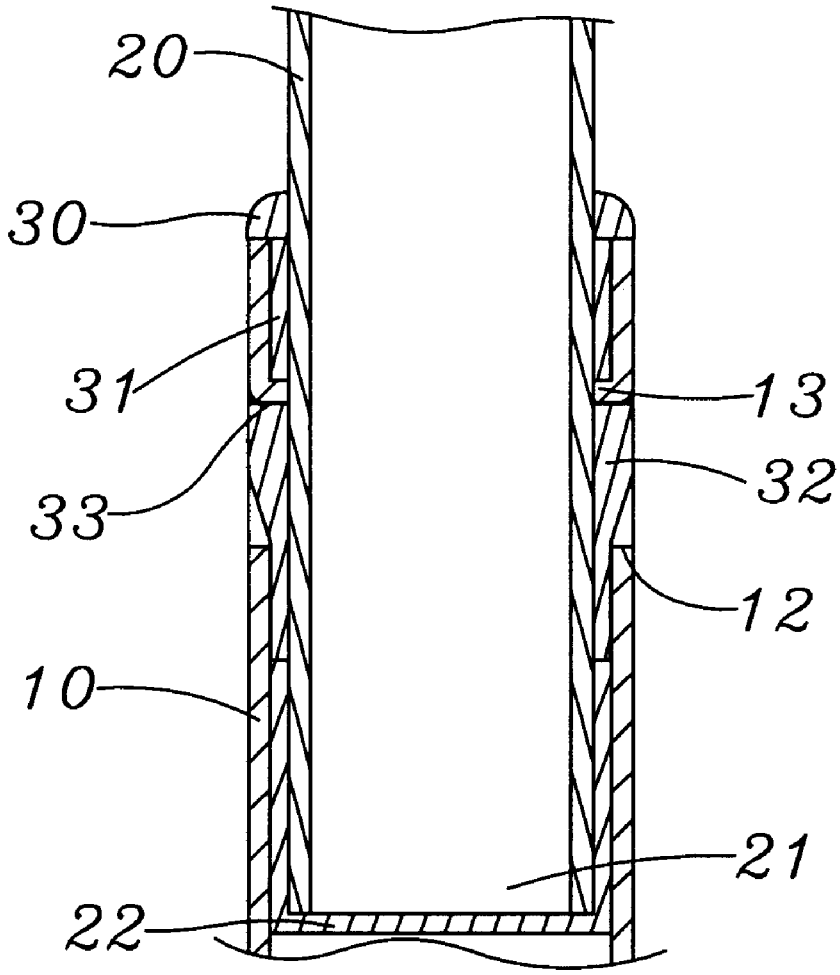
FIG. 6 is a cross-sectional view of the present invention.

As shown in FIG. 6, the present invention is characterized in that the extended sheet 13 is formed at the upper edge of each of the retaining holes 12 of the first joint tube 10 to increase the contact area of the upper edges of the retaining holes 12. Moreover, the contact surface of the retaining holes of the first joint tube 10 with the retaining buttons 32 of the positioning seat 30 is flat. When the second joint tube 20 is pulled upwards until the fixing element 22 at the bottom end of the second joint tube 20 sticks to the positioning seat 30, the positioning seat will bear an upward force. The retaining buttons 32 and the retaining holes 12 will bear this force via the upper edges thereof. Because the contact area of the upper edges of the retaining buttons 32 and the retaining holes 12 is larger, larger load can be born. The retaining buttons 32 will not break or be damaged because of large shearing force. The positioning seat 30 can thus be steadily joined at the upper opening 11 of the first joint tube 10 to achieve its positioning function.

Although the present invention has been described with reference to the preferred embodiments thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A positioning structure of a retractable draw bar comprising at least:

a first joint tube with two retaining holes respectively disposed on two opposite tube walls near an upper opening thereof, an extended sheet raised on the inner tube wall thereof being formed at the upper edge of each of said retaining holes; and a positioning seat with two retaining buttons respectively formed on two opposite sides thereof, said positioning seat being sheathed in said upper opening of said first joint tube, said positioning seat being joined at said upper opening through the fastening of said retaining buttons in contact with said retaining holes with said extended sheets of said first joint tube situated above said retaining buttons of said positioning seat.

2. The positioning structure of a retractable draw bar of claim 1, wherein the contact surface of said retaining holes of said first joint tube with said retaining buttons of said positioning seat is flat.

3. The positioning structure of a retractable draw bar of claim 1, wherein the bottom of said positioning seat forms a plugging part to be sheathed in said upper opening of said first joint tube, and said retaining buttons are respectively formed on two opposite sides of said plugging part of said positioning seat.

4. The positioning structure of a retractable draw bar of claim 1, wherein a through hole is disposed above each of said retaining buttons, and said extended sheets of said first joint tube are inserted in said through holes of said positioning seat.

5. The positioning structure of a retractable draw bar of claim 1, wherein two cut trenches whose bottoms are open are respectively disposed on other two opposite sides of said positioning seat.

* * * * *